US005761596A

United States Patent [19]

Osbourne et al.

[11] Patent Number: 5,761,596

[45] Date of Patent: Jun. 2, 1998

[54] PAPER PATH INLET BAFFLE

[75] Inventors: William G. Osbourne; Julio A. Sanchez-Banos, both of Webster; Alan R. Anderson, Sodus, all of N.Y.

[73] Assignee: Xerox Corporation, Stamford, Conn.

[21] Appl. No.: 651,460

[22] Filed: May 23, 1996

[51] Int. Cl.[6] ..... G03G 15/16; G03G 21/00

[52] U.S. Cl. ..... 399/316; 399/124; 399/317

[58] Field of Search ..... 399/121, 124, 399/316, 317

[56] References Cited

U.S. PATENT DOCUMENTS

| | | | |
|---|---|---|---|
| 4,110,027 | 8/1978 | Sato et al. | 399/317 |
| 4,358,197 | 11/1982 | Kukucka et al. | 355/14 R |
| 4,417,801 | 11/1983 | Eisemann | 355/35 H |
| 4,444,491 | 4/1984 | Rinehart et al. | 355/50 |
| 4,469,322 | 9/1984 | Kogure et al. | 271/264 |
| 4,478,506 | 10/1984 | Miyoshi et al. | 399/317 |
| 4,579,447 | 4/1986 | Kato | 355/35 H |
| 4,586,640 | 5/1986 | Smith | 227/14 |
| 4,871,158 | 10/1989 | May et al. | 270/53 |
| 4,908,674 | 3/1990 | Fukano et al. | 355/318 |
| 4,926,220 | 5/1990 | Matysek et al. | 355/313 |
| 4,947,214 | 8/1990 | Bayendell et al. | 399/316 |
| 5,018,717 | 5/1991 | Sadwick et al. | 271/207 |
| 5,225,879 | 7/1993 | Hayashida | 399/316 X |
| 5,268,724 | 12/1993 | Koizumi et al. | 355/274 |

*Primary Examiner*—Fred L. Braun
*Attorney, Agent, or Firm*—John S. Wagley

[57] ABSTRACT

An alignment baffle for use in a printing apparatus having a conveying mechanism for conveying images toward an image transfer area and copy sheet chute for guiding copy sheets toward the conveying mechanism is provided. The images are transferred to the copy sheets in the transfer area. The baffle includes a body operably associated with the image transfer area and a first member connected to the body and spaced from the copy sheet chute. The first member has a first member surface for guiding the copy sheet. The baffle also includes a second member operably associated with the first member, connected to the body and spaced from the copy sheet chute. The second member has a second member surface for guiding the copy sheet. The first member and the second member have a passageway therebetween for passage of the copy sheets therebetween. The first member surface and the second member surface cooperate with the copy sheets to guide the copy sheets in a path tangential to the conveying mechanism.

18 Claims, 5 Drawing Sheets

PAPER PATH INLET BAFFLE

This invention relates generally to an electrophotographic printing machine, and more particularly concerns an apparatus for delivering individual sets of compiled sheets to an off-line finishing machine.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

High speed copying machines are becoming increasingly popular. These machines have a capacity or output capacity of say, for example, over 60 copies per minute. These machines are able to use single cut sheets of paper of various size such as A4, 8½×11, or 8½×14 inch copy sheets. These machines may be of the light lens, xerographic machine or may be a printer with digital input. Single, cut sheet printing machines are now available at speeds around 200 cpm. When approaching the higher speeds of, for example, above 100 cpm, paper handling problems become much more acute. This is due to the greater velocity that the cut sheets must obtain to maintain the desired number of copies per minute.

Paper handling problems are particularly acute at transfer areas, those areas when the copy sheet must transfer one portion of the xerographic machine to another portion. One example of these areas is the transition from the supply bin or tray to the photoreceptor. Sheets are typically removed from the top of the supply bin or tray and moved by means of conveyors and rollers through a copy chute or lower baffle to an area adjacent the photoreceptor in order to transfer the developed image from the photoreceptor onto the copy sheet. The copy chute or lower baffle serves to align the copy sheet to the transfer area adjacent the photoreceptor.

In order to service components within the copy machine, as well as to assist in the removal of copy sheets during paper jams, the copy machine includes a series of modules, an example of a module being the photoreceptor belt and the photoreceptor assembly including the photoreceptor and the pulleys which support and rotate it. These modules are typically placed in drawers which are slidably extendible outwardly from one side of the machine to assist in replacing the photoreceptor and in removing jammed sheets from the photoreceptor. Likewise, the paper handling portions of the machine, for example, the copy chute is contained within a module which is movable by a drawer outward from a face of the machine to assist in replacement of components and to clear jams of copy sheets.

Because the copy chute module as well as the photoreceptor module need have clearance therebetween, a significant space or clearance is needed between the copy chute where the cut sheets are guided and the photoreceptor.

The distance between the photoreceptor and the copy chute requires an even larger gap because of the adjustment necessary to remove the photoreceptor belt as well as to adjust the tension of the photoreceptor belt against its pulleys. Additional adjustment is required and corresponding clearance is required between the alignment chute and the photoreceptor to allow for the alignment of the chute to the photoreceptor to accommodate for skew adjustments to the paper.

When the copy machine runs at high speeds, for example, 90 cpm or greater, the distance between the copy chute and the photoreceptor causes a lack of guidance of the paper. Typically, one of two things happen as the paper leaves the paper chute and approaches the transfer area adjacent to the photoreceptor. The first of these phenomenons causes a copy quality defect called lead edge disturbance. This defect is caused by the copy sheet stepping or impacting upon the photoreceptor. This impacting of the copy sheet against the photoreceptor also causes damage to the photoreceptor and reduces the life of the photoreceptor. The second of the two typical defects caused by the lack of guidance is trail edge defects. This is caused by the trailing edge of the slapping against the photoreceptor after it leaves the copy chute. Both of these image defects are due to a lack of the support of the paper during the paper's transition between the copy chute and the photoreceptor transfer area.

The following disclosures may be relevant to various aspects of the present invention:

- U.S. Pat. No. 5,268,724 Patentee: Koizumi, et al. Issue Date: Dec. 7, 1993
- U.S. Pat. No. 5,018,717 Patentee: Sadwick, et al. Issue Date: May 28, 1991
- U.S. Pat. No. 4,926,220 Patentee: Matysek, et al. Issue Date: May 15, 1990
- U.S. Pat. No. 4,908,674 Patentee: Fukano, et al. Issue Date: Mar. 13, 1990
- U.S. Pat. No. 4,871,158 Patentee: May, et al. Issue Date: Oct. 3, 1989
- U.S. Pat. No. 4,586,640 Patentee: Smith Issue Date: May 6, 1986
- U.S. Pat. No. 4,579,447 Patentee: Kato Issue Date: Apr. 1, 1986
- U.S. Pat. No. 4,469,322 Patentee: Kogure et al. Issue Date: Sep. 4, 1984
- U.S. Pat. No. 4,444,491 Patentee: Rinehart et al. Issue Date: Apr. 24, 1984
- U.S. Pat. No. 4,417,801 Patentee: Eisemann Issue Date: Nov. 29, 1983
- U.S. Pat. No. 4,358,197 Patentee: Kukucka Issue Date: Nov. 9, 1982

The relevant portions of the foregoing disclosures may be briefly summarized as follows:

U.S. Pat. No. 5,268,724 discloses a transfer apparatus including a photoreceptor drum having a transfer position and feeding rollers for feeding out a sheet of paper. A guide member is provided between the feeding rolls and photoreceptor drum. A guide surface on a lower surface of thereof guides the paper to the transfer position along the guide surface.

U.S. Pat. No. 5,018,717 discloses an apparatus in which an elevator movably supports a drawer having a tray associated therewith. The tray receives successive sheets at a loading station and the elevator moves continuously downward to maintain the uppermost sheet of the stack of sheets on the tray at a preselected location in the loading station until the drawer and tray are positioned at a discharge station located inside of a housing. The sheets are then transferred to an unloading station external of the housing.

U.S. Pat. No. 4,926,220 discloses a dual-mode apparatus in which sets of sheets are delivered to an operator in response to a selected mode of operation. Sets of sheets are advanced from the loading station to the unloading station for delivery to the operator. In one mode of operation, the sets are advanced from the loading station to the unloading station after the completion of each job and in another mode of operation, the sets of sheets are advanced from the loading station to the unloading station after the maximum number of sets of sheets have been stacked at the loading station independent of the number of jobs.

U.S. Pat. No. 4,908,674 discloses an image forming apparatus including a paper delivery section for guiding paper to a space between a photoreceptor and a transferring corona discharger. The paper is guided as it is turned over after having passed between a pair of arcuate reversing guides. A portion of the paper delivery section is formed as a unit which can be integrally pulled out from the body of the apparatus.

U.S. Pat. No. 4,871,158 discloses a copying finisher system having a compiling station for receiving a collated copy set prior to stapling. The station is defined by reciprocally movable horizontally arranged collecting plate upon which the copy sheets are collected. The arrangement presents the leading edge of the sheets to the clamping position of one or more staplers. After collection of the copy sheets, the leading edge of the set is clamped and stapled while the plate is moved to permit dropping of the finished set.

U.S. Pat. No. 4,586,640 describes an apparatus in which a plurality of sheets are attached to one another to form a booklet thereof. Sheets are compiled to form a set which is then advanced to a stapling apparatus and/or a binding apparatus.

U.S. Pat. No. 4,579,447 discloses a copy machine including a feeding device for feeding a copy paper to a circular photoreceptor for forming a latent image thereon. The copy paper is transferred along a line tangent to the transfer portion of the photoreceptor.

U.S. Pat. No. 4,469,322 discloses a paper guide member that is adjacent to a receptor along a paper transport path. The member includes a bifurcation slot having a width greater than the typical width of a stiff paper but narrower than the width of most thinner papers to permit the stiff papers to deform out of the paper transport path upon contacting the receptor.

U.S. Pat. No. 4,444,491 discloses a very high speed fully automated reproduction system having a post-collation device for the arrangement of copy sheets into copy sets. A sorter bin array having a number of bins equal to a predetermined number of sets is arranged to collate the resulting copy sheets in the corresponding copy sets. The copy sets are then removed from the bin array for stapling and/or stacking and non-stapling.

U.S. Pat. No. 4,417,801 discloses a copy sheet registration arrangement for a copier finisher system. Sheets are transported to a compiler station for the finisher and are subject to a two-step registration process.

U.S. Pat. No. 4,358,197 discloses a copy set collecting and storage arrangement for a high speed reproduction system having a finishing station. The arrangement includes an elevator for collecting finished copy sets in a stack and a conveyor for receiving one or more stacks from the elevator.

In accordance with one aspect of the present invention, there is provided an alignment baffle for use in a printing apparatus having a conveying mechanism for conveying images toward an image transfer area and copy sheet chute for guiding copy sheets toward the conveying mechanism. The images are transferred to the copy sheets in the transfer area. The baffle includes a body operably associated with the image transfer area and a first member connected to the body and spaced from the copy sheet chute. The first member has a first member surface for guiding the copy sheet. The baffle also includes a second member operably associated with the first member, connected to the body and spaced from the copy sheet chute. The second member has a second member surface for guiding the copy sheet. The first member and the second member have a passageway therebetween for passage of the copy sheets therebetween. The first member surface and the second member surface cooperate with the copy sheets to guide the copy sheets in a path tangential to the conveying mechanism.

Pursuant to another aspect of the present invention, there is provided an electrophotographic printing machine including a conveying mechanism for conveying images toward an image transfer area and a copy sheet chute for guiding copy sheets toward said conveying mechanism. The machine also includes a body operably associated with the image transfer area and a first member connected to the body and spaced from the copy sheet chute. The first member has a first member surface for guiding the copy sheet. The baffle also includes a second member operably associated with the first member, connected to the body and spaced from the copy sheet chute. The second member has a second member surface for guiding the copy sheet. The first member and the second member have a passageway therebetween for passage of the copy sheets therebetween. The first member surface and the second member surface cooperate with the copy sheets to guide the copy sheets in a path tangential to the conveying mechanism.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 2:
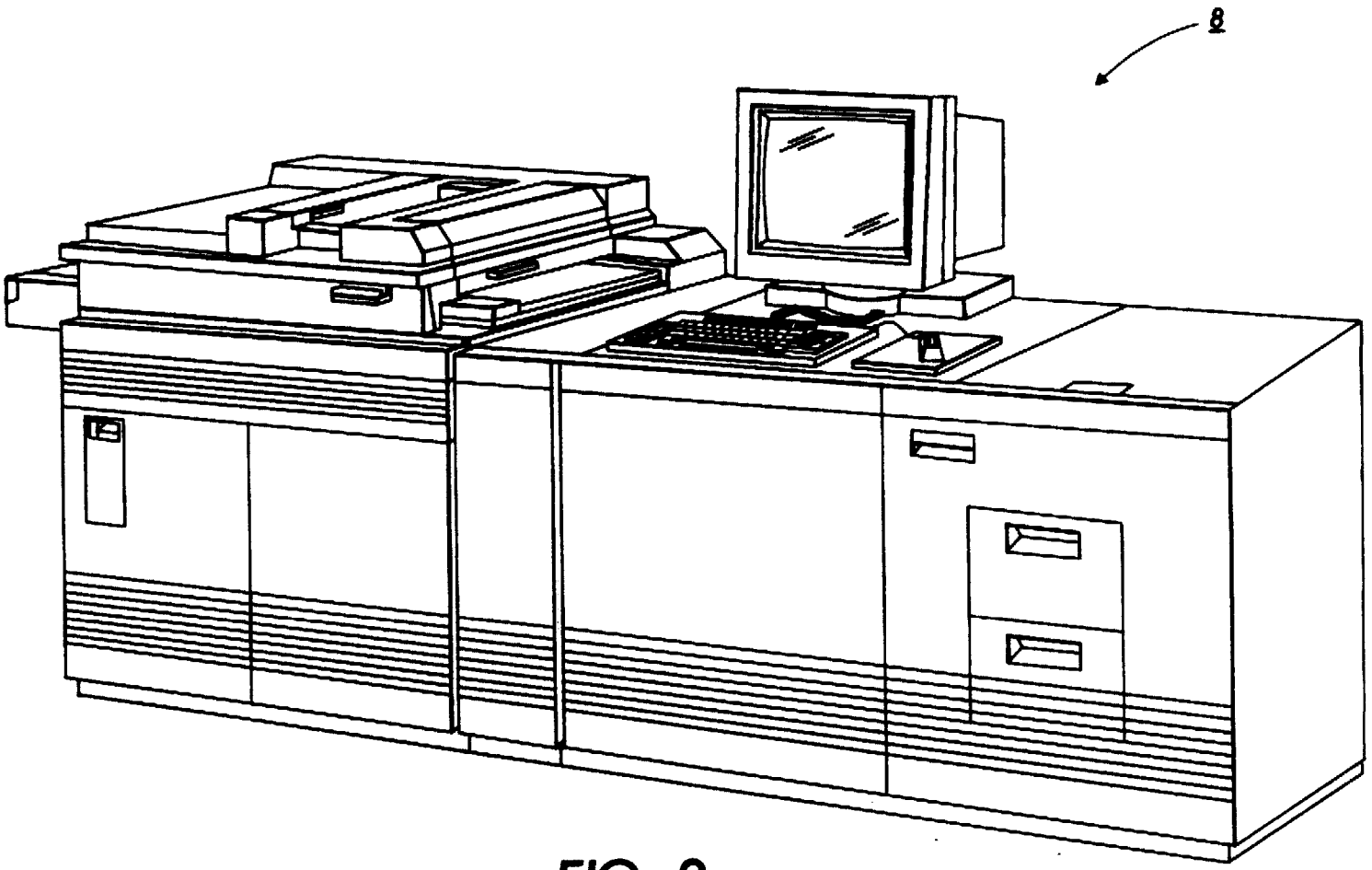
FIG. 2 is a perspective view depicting an illustrative electrophotographic printing machine.

For a general understanding of the features of the present invention, reference is made to the drawings. In the drawings, like reference numerals have been used throughout to identify identical elements. FIG. 2 is a perspective view of a modern copy machine 8 that may utilize the alignment baffle of the present invention. The machine of FIG. 2 is shown schematically in FIG. 3 which depicts the electrophotographic printing machine 8 incorporating the features of the present invention therein.

It will become evident from the following discussion that the alignment baffle of the present invention may be employed in a wide variety of machines and is not specifically limited in its application to the particular embodiment depicted herein.

Figure 3:
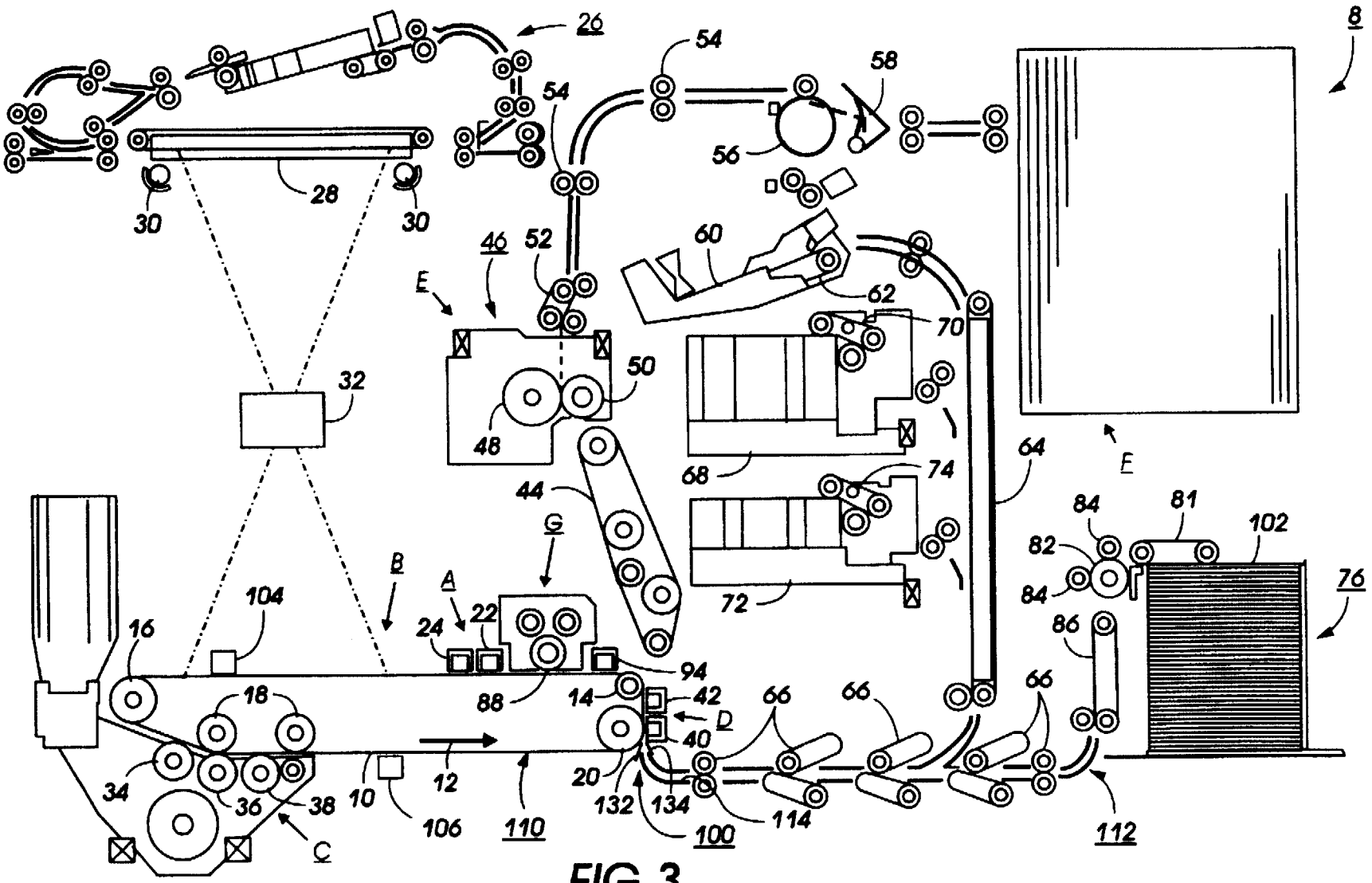
FIG. 3 is a schematic elevational view of the printing machine of FIG. 2 incorporating the paper path inlet baffle of FIG. 1.

Referring to FIG. 3 of the drawings, the electrophotographic printing machine employs a photoconductive belt 10. Preferably, the photoconductive belt 10 is made from a photoconductive material coated on a ground layer, which, in turn, is coated on an anti-curl backing layer. The photoconductive material is made from a transport layer coated on a selenium generator layer. The transport layer transports positive charges from the generator layer. The generator layer is coated on an interface layer. The interface layer is coated on the ground layer made from a titanium coated Mylar™. The interface layer aids in the transfer of electrons to the ground layer. The ground layer is very thin and allows light to pass therethrough. Other suitable photoconductive materials, ground layers, and anti-curl backing layers may also be employed. Belt 10 moves in the direction of arrow 12 to advance successive portions sequentially through the various processing stations disposed about the path of movement thereof. Belt 10 is entrained about stripping roller 14, tensioning roller 16, idler roll 18 and drive roller 20. Stripping roller 14 and idler roller 18 are mounted rotatably so as to rotate with belt 10. Tensioning roller 16 is resiliently urged against belt 10 to maintain belt 10 under the desired tension. Drive roller 20 is rotated by a motor coupled thereto by suitable means such as a belt drive. As roller 20 rotates, it advances belt 10 in the direction of arrow 12.

Initially, a portion of the photoconductive surface passes through charging station A. At charging station A, two corona generating devices indicated generally by the reference numerals 22 and 24 charge the photoconductive belt 10 to a relatively high, substantially uniform potential. Corona generating device 22 places all of the required charge on photoconductive belt 10. Corona generating device 24 acts as a leveling device, and fills in any areas missed by corona generating device 22.

Next, the charged portion of the photoconductive surface is advanced through imaging station B. At imaging station B, a document handling unit indicated generally by the reference numeral 26 is positioned over platen 28 of the printing machine. Document handling unit 26 sequentially feeds documents from a stack of documents placed by the operator face-up in a normal forward collated order in the document stacking and holding tray. A document feeder located below the tray, forwards the bottom document in the stack to a pair of take-away rollers. The bottom sheet is then fed by the rollers through a document guide to a feed roll pair and belt. The belt advances the document to platen 28. After imaging, the original document is fed from platen 28 by the belt into a guide and feed roll pair. The document then advances into an inverter mechanism and back to the document stack through the feed roll pair. A position gate is provided to divert the document to the inverter or to the feed roll pair. Imaging of the document is achieved by lamps 30 which illuminate the document on a platen 28. Light rays reflected from the document are transmitted through the lens 32. Lens 32 focuses light images of the document onto the charged portion of the photoconductive belt 10 to selectively dissipate the charge thereon. This records an electrostatic latent image on the photoconductive belt which corresponds to the informational areas contained within the original document. Thereafter, belt 10 advances the electrostatic latent image recorded thereon to development station C.

Obviously, electronic imaging of page image information could be facilitated by a printing apparatus utilizing electrical imaging signals. The printing apparatus can be a digital copier including an input device such as a raster input scanner (RIS) and a printer output device such as a raster output scanner (ROS), or, a printer utilizing a printer output device such as a ROS. Other types of imaging systems may also be used employing, for example, a pivoting or shiftable LED write bar or projection LCD (liquid crystal display) or other electro-optic display as the "write" source.

Thereafter, belt 10 advances the electrostatic latent image recorded thereon to development station C. Development station C has three magnetic brush developer rolls indicated generally by the reference numerals 34, 36 and 38. A paddle wheel picks up developer material and delivers it to the developer rolls. When the developer material reaches rolls 34 and 36, it is magnetically split between the rolls with half of the developer material being delivered to each roll. Photoconductive belt 10 is partially wrapped about rolls 34 and 36 to form extended development zones. Developer roll 38 is a clean-up roll. A magnetic roll, positioned after developer roll 38, in the direction of arrow 12 is a carrier granule removal device adapted to remove any carrier granules adhering to belt 10. Thus, rolls 34 and 36 advance developer material into contact with the electrostatic latent image. The latent image attracts toner particles from the carrier granules of the developer material to form a toner powder image on the photoconductive surface of belt 10. Belt 10 then advances the toner powder image to transfer station D.

At transfer station D, a copy sheet 102 is moved into contact with the toner powder image. First, photoconductive belt 10 is exposed to a pre-transfer light from a lamp (not shown) to reduce the attraction between photoconductive belt 10 and the toner powder image. Next, a corona generating device 40 charges the copy sheet to the proper magnitude and polarity so that the copy sheet is tacked to photoconductive belt 10 and the toner powder image attracted from the photoconductive belt to the copy sheet. After transfer, corona generator 42 charges the copy sheet to the opposite polarity to detack the copy sheet from belt 10. Conveyor 44 advances the copy sheet to fusing station E.

Fusing station E includes a fuser assembly indicated generally by the reference numeral 46 which permanently affixes the transferred toner powder image to the copy sheet. Preferably, fuser assembly 46 includes a heated fuser roller 48 and a pressure roller 50 with the powder image on the copy sheet contacting fuser roller 48. The pressure roller is cammed against the fuser roller to provide the necessary pressure to fix the toner powder image to the copy sheet. The fuser roll is internally heated by a quartz lamp. Release agent, stored in a reservoir, is pumped to a metering roll. A trim blade trims off the excess release agent. The release agent transfers to a donor roll and then to the fuser roll.

After fusing, the copy sheets are fed through a decurler 52. Decurler 52 bends the copy sheet in one direction to put a known curl in the copy sheet and then bends it in the opposite direction to remove that curl.

Forwarding rollers 54 then advance the sheet to duplex turn roll 56. Duplex solenoid gate 58 guides the sheet to the finishing station F, or to duplex tray 60. At finishing station F, copy sheets are stacked in a compiler tray and attached to one another to form sets. The sheets can be attached to one another by either a binder or a stapler. In either case, a plurality of sets of documents are formed in finishing station F. When duplex solenoid gate 58 diverts the sheet into duplex tray 60. Duplex tray 60 provides an intermediate or buffer storage for those sheets that have been printed on one side and on which an image will be subsequently printed on the second, opposite side thereof, i.e., the sheets being duplexed. The sheets are stacked in duplex tray 60 facedown on top of one another in the order in which they are copied.

In order to complete duplex copying, the simplex sheets in tray 60 are fed, in seriatim, by bottom feeder 62 from tray 60 back to transfer station D via conveyor 64 and rollers 66 for transfer of the toner powder image to the opposed sides of the copy sheets. Inasmuch as successive bottom sheets are fed from duplex tray 60, the proper or clean side of the copy sheet is positioned in contact with belt 10 at transfer station D so that the toner powder image is transferred thereto. The duplex sheet is then fed through the same path as the simplex sheet to be advanced to finishing station F.

Copy sheets are fed to transfer station D from secondary tray 68. The secondary tray 68 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 70. Sheet feeder 70 is a friction retard feeder utilizing a feed belt and take-away rolls to advance successive copy sheets to transport 64 which advances the sheets to rolls 66 and then to transfer station D.

Copy sheets may also be fed to transfer station D from the auxiliary tray 72. The auxiliary tray 72 includes an elevator driven by a directional AC motor. Its controller has the ability to drive the tray up or down. When the tray is in the down position, stacks of copy sheets are loaded thereon or unloaded therefrom. In the up position, successive copy sheets may be fed therefrom by sheet feeder 74. Sheet feeder 74 is a friction retard feeder utilizing a feed belt and take-away rolls to advance successive copy sheets to transport 64 which advances the sheets to rolls 66 and then to transfer station D.

Secondary tray 68 and auxiliary tray 72 are secondary sources of copy sheets. The high capacity sheet feeder, indicated generally by the reference numeral 76, is the primary source of copy sheets. Feed belt 81 feeds successive uppermost sheets from the stack to a take-away drive roll 82 and idler rolls 84. The drive roll and idler rolls guide the sheet onto transport 86. Transport 86 advances the sheet to rolls 66 which, in turn, move the sheet to transfer station D.

Invariably, after the copy sheet is separated from the photoconductive belt 10, some residual particles remain adhering thereto. After transfer, photoconductive belt 10 passes beneath corona generating device 94 which charges the residual toner particles to the proper polarity. Thereafter, the pre-charge erase lamp (not shown), located inside photoconductive belt 10, discharges the photoconductive belt in preparation for the next charging cycle. Residual particles are removed from the photoconductive surface at cleaning station G. Cleaning station G includes an electrically biased cleaner brush 88 and two de-toning rolls. The reclaim roll is electrically biased negatively relative to the cleaner roll so as to remove toner particles therefrom. The waste roll is electrically biased positively relative to the reclaim roll so as to remove paper debris and wrong sign toner particles. The toner particles on the reclaim roll are scraped off and deposited in a reclaim auger (not shown), where it is transported out of the rear of cleaning station G.

The various machine functions are regulated by a controller. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the document and the copy sheets. In addition, the controller regulates the various positions of the gates depending upon the mode of operation selected.

Referring again to FIG. 3, and according to the present invention, an alignment baffle 100 is shown. The alignment baffle 100 is used to guide copy sheets 102 as they pass from the rolls 66 to the image transfer area D. Latent images 104 are formed the image station B and are formed in the photoconductive belt 10. As the photoconductive belt 10 translates in the direction of arrow 12 toward the development station C, the latent image 104 is developed into developed image 106. The developed image 106 is further translated along the photoconductive belt in the direction of arrow 12 toward the image transfer area D. At image transfer area D, the developed image 106 is transferred from the photoconductive belt 10 to copy sheet 102.

As shown in FIG. 3, a conveying mechanism 110 is in the form of photoconductive belt 10 which translates the developed image 106 in the direction of arrow 12. The photoconductive belt 10 is held in position by rollers 14, 16, 18 and 20. In order to adjust the tension of the photoconductive belt 10 and to permit replacement of the photoconductive belt 10, at least one of the rollers is mounted in an adjustable track to permit the tightening and positioning of the photoconductive belt 10. Further, to properly align the copy sheets 102 as they enter the image transfer area D, the rolls 66 are mounted in a copy sheet feed module 112 which provides support for the rolls 66 as well as for copy chute or lower baffle 114. It should be appreciated, however, that the alignment baffle of the present invention may be practiced with the developed image being transferred by an intermediate belt or by a photoconductive drum.

Figure 4:
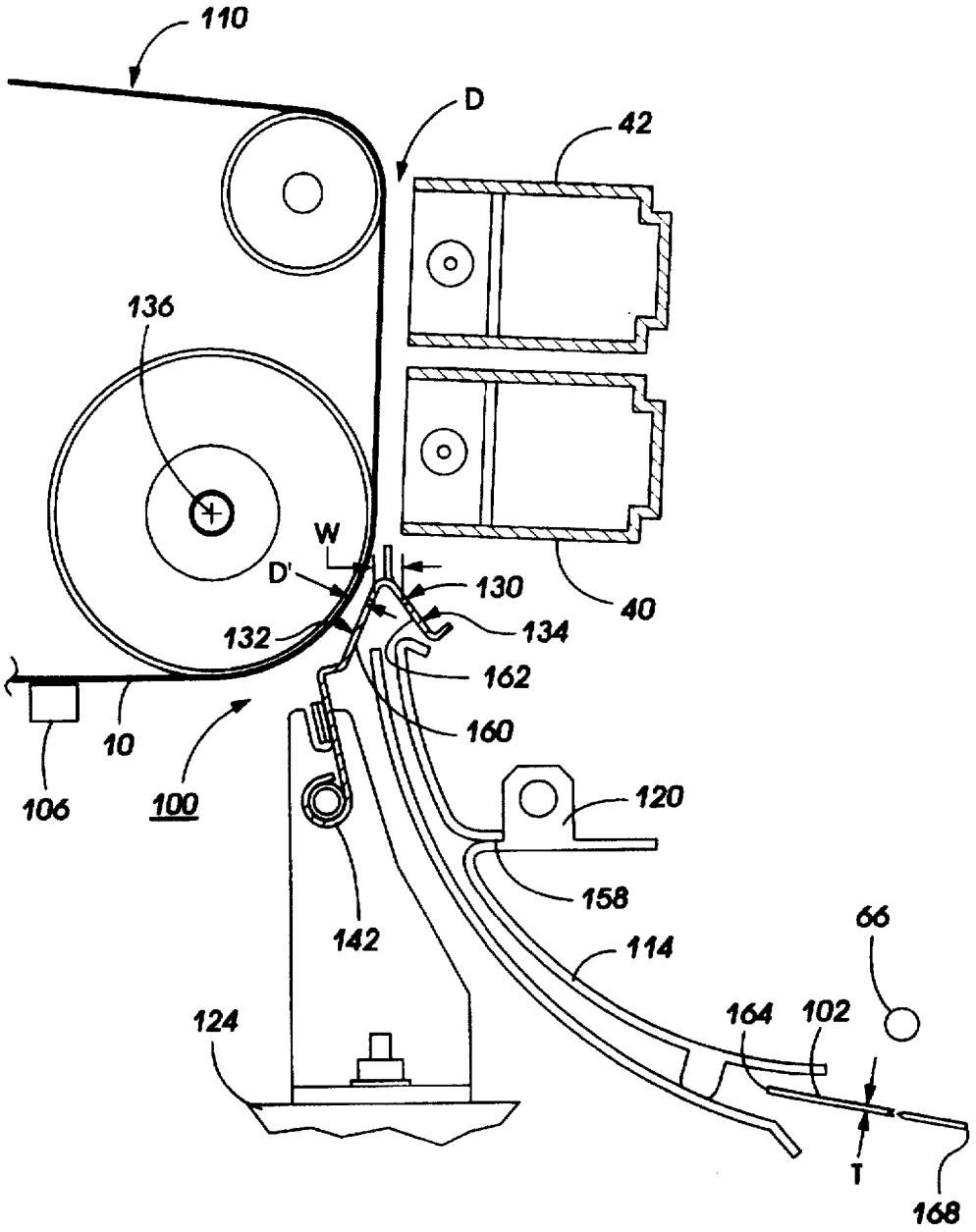
FIG. 4 is an end view of the paper path inlet baffle of FIG. 1 installed in the FIG. 2 printing machine.

Referring now to FIG. 4, the alignment baffle 100 is shown in greater detail. The alignment baffle 100 is shown in the position between the image transfer area D and the copy chute 114. To accommodate the skewing alignment of the copy chute 114 relative to conveying mechanism 110, the conveying mechanism 110 must be positionable relative to the copy chute 114. Thus, there is relative motion between the copy mechanism 110 and the copy chute 114. Typically, the copy chute is supported by copy chute support 120 while the conveying mechanism 110 is supported by body 124. The alignment baffle 100 is spaced from the copy chute 114 and is likewise spaced from the photoreceptor belt 10. The alignment baffle 100 includes a passageway 130 through which the copy sheet 102 passes as it leaves the copy chute 114 on its trip to the image transfer area D. The passageway 130 has a width W which is greater than thickness T of the copy sheet 102. Applicants have found that alignment baffle 100 with a width W of 2 mm to 6 mm approximately is effective.

The alignment baffle 100 may have any suitable shape suitable to guide the copy sheet 102 to a position in the image transfer area D. The alignment baffle 100 preferably includes a first member 132 and a second member 134. The passageway 130 is located between the first member 132 and the second member 134. Preferably, the first and second members 132, 134 are movable with the body 124 so that the positioning of the first member 132 and the second member 134 is always accurate with respect to the body 124, and consequently with the conveying mechanism 110, in particular, the photoconductive belt 10. In this way, in spite of the adjustments of the photoconductive belt and in spite of adjustments between the copy chute 114 and the conveying mechanism 110, the alignment baffle 100 will consistently place the copy sheet 102 in a proper location with respect to the photoconductive belt 10.

As shown in FIG. 4, a simple way to have the alignment baffle 100 movable with the photoconductive belt 10, is to have the alignment baffle 100 mounted to the body 124. While the alignment baffle 100 may be fixedly mounted to the body 124, preferably, to accommodate the removal of the conveying mechanism 110 in a direction along axis 136 the alignment baffle 100 is preferably separable from the position of the alignment baffle 100 during operating conditions to permit the axial movement of the conveying mechanism 110.

Figure 5:
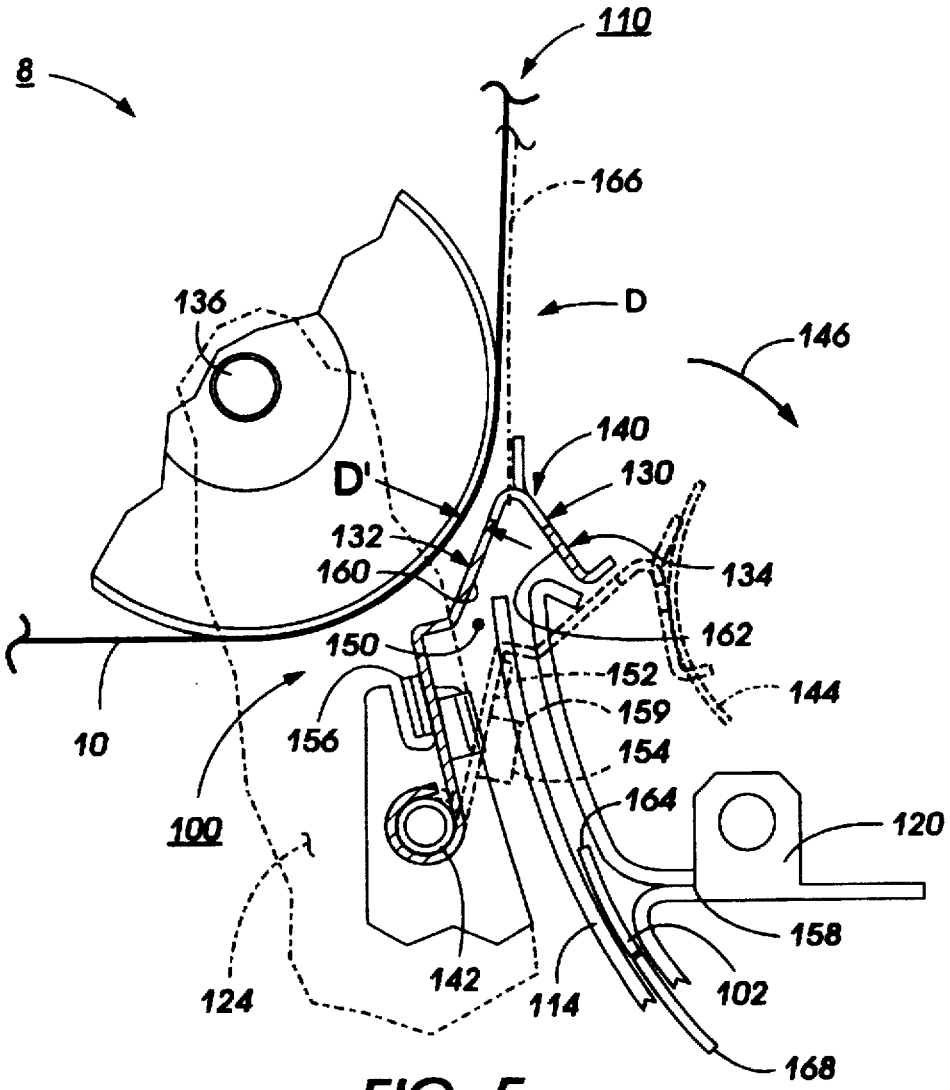
FIG. 5 is an end view of the paper path inlet baffle of FIG. 1 shown in greater detail.

Referring now to FIG. 5, the alignment baffle 100 is shown in greater detail with the alignment baffle 100 shown in a first position 140 with first member 132 adjacent the photoconductive belt 10. While the alignment baffle 100 may be separable from the photoconductive belt 10 in any suitable fashion, preferably, the alignment baffle is pivotable about a pivoting bushing 142 from the first position 140 to a second position 144 as the alignment baffle 100 rotates in the direction of arrow 146. Preferably, the alignment baffle 100 is biased in the first position 140 when the alignment baffle is fully installed within the copy machine 8, and biased in second position 144 while the conveying mechanism 110 is being removed and reinstalled into the copy machine 8.

The biasing of the alignment baffle 100 can be accomplished in any suitable fashion, but preferably, the alignment baffle is so positioned such that center of gravity 150 causes the alignment baffle 100 to rotate in the direction of arrow 146 against first stop 152. As the conveying mechanism 110 is returned to the operating position, an urging member 154 contacts the alignment baffle 100 urging it in a direction opposed to the arrow 146. Second stop 156 limits the travel of the rotation of the alignment baffle to accurately position the distance D' between the first member 132 and the photoconductive belt 10. The distance D' may be minimized to a dimension as close as is effective for the proper guidance of the copy sheet 102. Preferably, the applicants have found that a distance D' of from approximately 2.0 mm to 6.0 mm is effective in guiding the copy sheet 102. The second stop 156 is preferably connected to body 124. The urging member 154 may be made of any suitable material, for example, a leaf-spring made of spring steel.

To prevent the uncontrolled bleeding of ions from the copy sheet 102, the copy chute 114 is electrically isolated from the machine ground (not shown). A bleed block 158 is preferably electrically connected to the copy chute 114 and controls the bleeding of ions from the copy sheet 102. Similar to the copy sheet 102, the alignment baffle 100 should similarly be electrically isolated from the machine ground. The bleed block 158 thus preferably is electrically connected to the alignment baffle 100 and controls the bleeding of ions from the copy sheet 102. The urging member 154 is preferably positioned between the baffle 100 and contact point 159 of the copy chute 114 which is electrically connected to the bleed block 158, thereby electrically connecting the alignment baffle 100 to the bleed block 158, thereby controlling the bleeding of the ions on the copy sheet 102.

First member 132 and second member 134 may be separate components. The first member 132 as well as the second member 134 may be made of any suitable, durable material, for example, a metal or a synthetic material, i.e. plastic. Preferably, the first member 132 and the second member 134 are operably connected to the body 124. By being connected to the body 124, the first member 132 and the second member 134 may be accurately positioned with respect to the photoconductive belt 10 independent of the alignment or positioning of the copy chute 114. The first member 132 includes a first member surface 160 adjacent the copy chute 114 while the second member 134 includes a second member surface 162 adjacent the copy chute 114.

As the copy sheet 102 travels through the copy chute 114, depending on the relative alignment of the alignment baffle 100 with respect to the copy chute 114, leading edge 164 of the copy sheet 102 will contact either first surface 160 or second surface 162, or passes uninhibited through the passageway 130. If the leading edge 164 of the copy sheet 114 contacts the first surface 162, the leading edge 164 is urged toward the passageway 130. Likewise, if the leading edge 164 contacts the second surface 162, the leading edge 164 is urged toward the passageway 130. Thereby the leading edge 164 is directed into the passageway 130. Thereby the addition of the alignment baffle 100 provides for a very accurate positioning of the leading edge 164 as it approaches the photoconductive belt 10.

Preferably, to avoid the impacting of the leading edge 164 of the copy sheet 102 against the photoconductive belt 10, the alignment baffle 100 and its passageway 130 are so positioned relative to the copy chute 114 and the photoconductive belt 10 such that the copy sheet 102 tangentially contacts the photoconductive belt 10. In other words, the copy sheet 102 has a copy sheet paper centerline 166 as the copy sheet 102 exits the passageway 130 which centerline 166 is parallel and ever so slightly spaced from the photoconductive belt 10 in the transfer area D. Correspondingly, trailing edge 168 of copy sheet 102 is guided by baffle 100 as it approaches the belt 10 in a direction slightly spaced from and generally parallel to the belt along centerline 166 to gently position the trailing edge of the copy sheet 102 on the belt 10.

While the alignment baffle 100 may be made from a first member 132 and a second member 134 which are separate and distinct, for simplicity and as shown in FIGS. 4 and 5, the first member 132 and the second member 134 may be integral with each other. The alignment baffle 100 may be made of any suitable, durable material, e.g. a metal, i.e. sheet steel or be molded of any durable material, e.g. a plastic or a composite material. Preferably, and as shown in FIGS. 4 and 5, the alignment baffle 100 is made from sheet steel and preferably fabricated from a flat piece of steel.

Figure 4A:
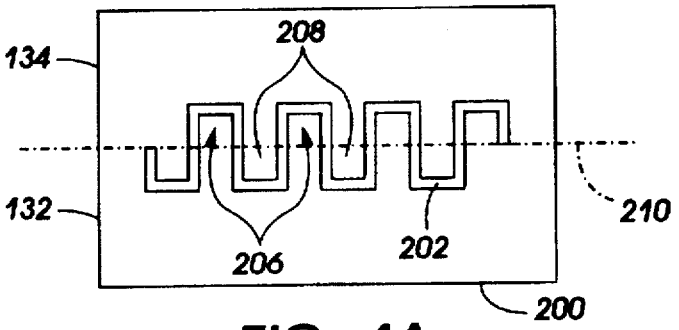
FIG. 4A is an plan view of a sheet metal blank that may be used to fabricate the paper path inlet baffle of FIG. 1.

Referring now to FIG. 4A, a blank 200 is shown from which the alignment baffle 100 may be made. The blank 200 includes an opening 202 which forms a first set of protrusions 206 and a second set of protrusions 208. The blank 200 is bent with the opening 202 forming passageway 130.

Protrusions 206 are formed into first member 132, while protrusions 208 are formed into second member 134. This is accomplished by bending the blank 200 around centerline 210.

Figure 1:
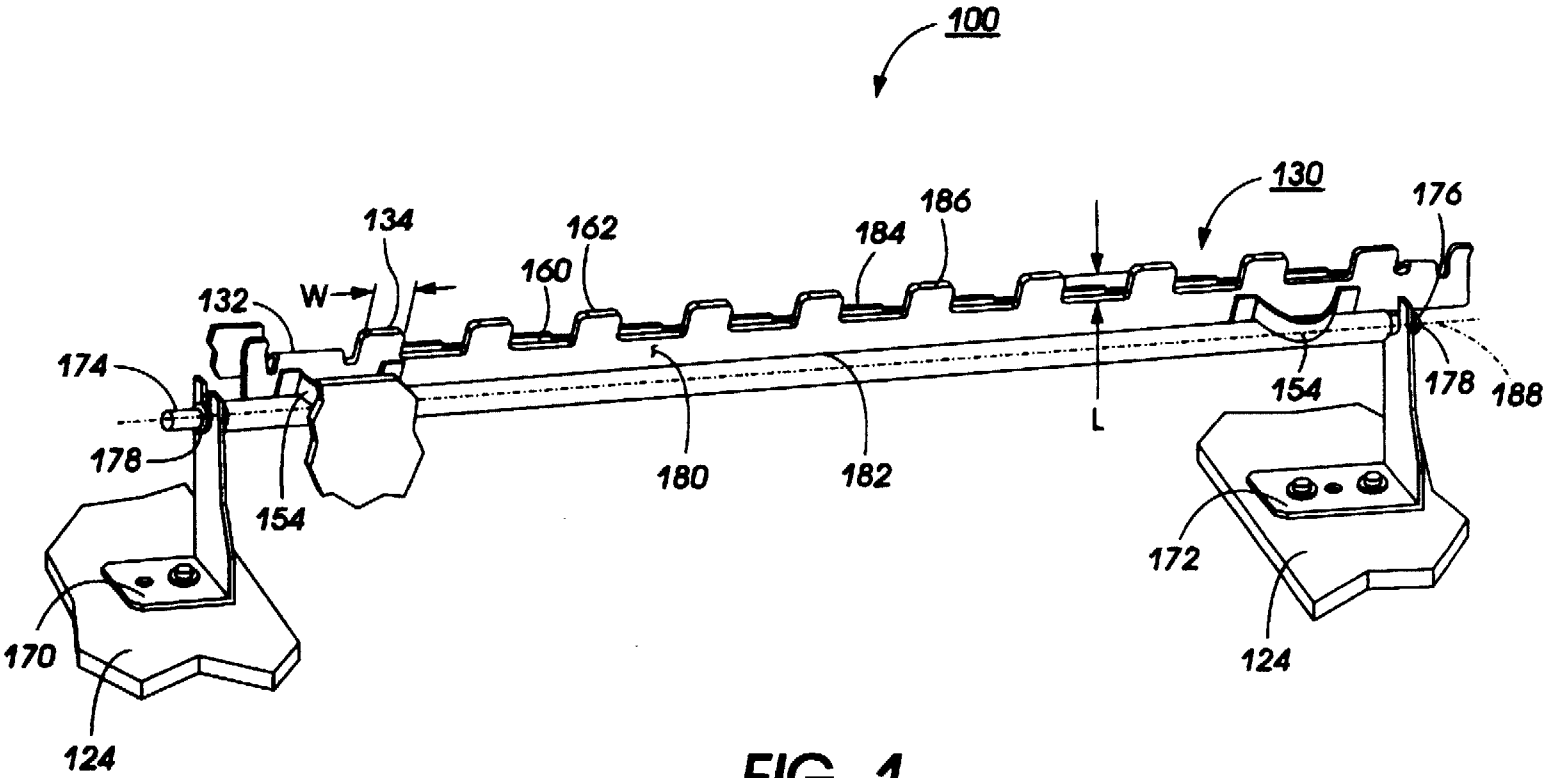
FIG. 1 is a perspective view of an illustrative paper path inlet baffle according to the present invention.

Referring now to FIG. 1, the alignment baffle 100 is shown in greater detail. The alignment baffle 100 may be connected to the conveyor mechanism body 124 in any suitable fashion. As shown in FIG. 1, the alignment baffle 100 is connected to the conveyor mechanism body 124 by first and second brackets 170 and 172, respectively. The brackets 170 and 172 contain pins 174 and 176 about which alignment baffle body 180 of the alignment baffle 100 pivots. Preferably, the bushings 142 are electrically insulative and are located over pins 174 and 176 and electrically isolate the pins from the brackets 170 and 172. The bushings 142 are made of any suitable durable insulative material for example a plastic material. First member 132 and second member 134 extend outwardly from the body 180. First edge 182 of the body 180 is preferably curled into a tubular shape whereby the body 180 may rotate about the pins 174 and 176. The first member 132 includes a first member protrusion 184, while the second member 134 includes a second member protrusion 186. The protrusions 184 and 186 extend beyond the passageway 130 and assist to further guide the copy sheet 102 to its proper position in the transfer area D (see FIGS. 4 and 5).

The protrusions 184 and 186 may have any suitable shape and, as stated earlier, may be formed from the blank 200 (see FIG. 4A). Preferably, the first and second protrusions 184 and 186 are preferably equally and alternatively spaced along axis 188 of the alignment baffle 100. The protrusions 184 and 186 have a length L satisfactory to maintain the minimum distance D' (see FIGS. 4 and 5). The first and second protrusions 184 and 186 may have a width W suitable to maintain an adequately durable protrusion, for example, the protrusions 184 and 186 may have a width W of 1.0 cm approximately.

By providing an alignment baffle that is associated with the photoconductive belt, an alignment baffle can be provided which is independent of the adjustment of the photoconductive belt and the alignment of the copy chute to the alignment belt for skew.

By providing an alignment baffle that is biased toward the photoconductive belt when in operating position, and biased away from the photoconductive belt when not in an operational position, an alignment baffle can be provided that permits the sliding of the photoconductive belt out of the machine in a sliding module.

By providing an alignment baffle that is registered or rests against the conveying mechanism, an alignment baffle can be provided that accurately positions the copy sheet in the transfer zone.

By providing an alignment baffle that rotates away from the photoconductive belt as the photoconductive belt is removed from the copy machine, an alignment baffle can be provided that accurately positions the copy sheet while providing easy loading of the photoconductor.

By providing an alignment baffle that is separated from the photoconductive belt as well as from the copy chute, an alignment baffle can be provided that is electrically isolated from the paper path but common with both the lower baffle by providing springs that contact the lower baffle to the alignment device.

By providing an alignment baffle that includes stops which are positioned on the photoreceptor module an alignment baffle can be provided that accurately positions the copy sheet with respect to the photoconductive member in the transfer area.

By providing an alignment baffle that is pivotable and is independent of the copy chute, an alignment baffle can be provided that accurately positions the copy sheet within the transfer area.

By providing an alignment baffle that may be positioned very close to the photoconductive member disturbance of the developed image caused by the copy sheet lead edge contacting the photoconductive member can be greatly reduced.

By providing an alignment baffle that is very closely positionable with respect to the photoconductive belt, the disturbance of the developed image by the trailing edge of the paper slapping against the photoconductive belt can be greatly reduced.

By providing an alignment baffle that is electrically isolated from ground the bleeding of ions from the copy sheet may be limited.

By providing an alignment baffle that is electrically connected to the bleed block the bleeding of ions from the copy sheet may be accurately controlled.

In recapitulation, there is provided an individual sheet set ejector mechanism which is capable of operating at machine process speed and delivers individual attached or unattached sets of sheets to a location external of the electrophotographic printing machine for further processing.

As a result of the configuration of the set ejector mechanism, the lead edge of the compiled sheet set is always delivered to substantially the same location independent of the sheet size. This allows a wide variety of off-line finishing or processing machines to be utilized in conjunction with the ejector mechanism.

It is, therefore, apparent that there has been provided in accordance with the present invention, an individual set ejector mechanism that fully satisfies the aims and advantages hereinbefore set forth.

While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An apparatus having a conveying mechanism for conveying images toward an image transfer area and copy sheet chute for guiding copy sheets toward the conveying mechanism, the images being transferred to the copy sheets in the transfer area, the improvement characterized by a alignment baffle comprising:

a body operably associated with the image transfer area;

a first member connected to said body and spaced from the copy sheet chute, said first member having a first member surface for guiding the copy sheet; and a second member operably associated with said first member, connected to said body and spaced from the copy sheet chute, said second member having a second member surface for guiding the copy sheet, said first member and said second member defining a passageway therebetween for passage of the copy sheets therebetween, said first member surface and said second member surface cooperating with the copy sheets to guide the copy sheets in a path tangential to the conveying mechanism, said first member and said second member being integral with each other.

2. An apparatus according to claim 1, wherein said body is connected to the conveying mechanism.

3. An apparatus according to claim 1, wherein at least one of said first member and said second member are pivotably connected to said body.

4. An apparatus according to claim 1, wherein at least one of said first member and said second member comprises a metal.

5. An apparatus according to claim 1, wherein at least one of said first member and said second member comprises a protrusion extending toward the passageway.

6. An apparatus according to claim 1, wherein the passageway has a width of approximately 2–6 mm.

7. An apparatus according to claim 1, wherein at least one of said first member and said second member is spaced approximately 2–6 mm from the conveying mechanism.

8. In a printing apparatus having a conveying mechanism for conveying images toward an image transfer area and copy sheet chute for guiding copy sheets toward the conveying mechanism, the images being transferred to the copy sheets in the transfer area, the improvement characterized by a alignment baffle comprising:

a body operably associated with the image transfer area;

a first member connected to said body and spaced from the copy sheet chute, said first member having a first member surface for guiding the copy sheet;

a second member operably associated with said first member, connected to said body and spaced from the copy sheet chute, said second member having a second member surface for guiding the copy sheet, at least one of said first member and said second member are pivotably connected to said body, said first member and said second member defining a passageway therebetween for passage of the copy sheets therebetween, said first member surface and said second member surface cooperating with the copy sheets to guide the copy sheets in a path tangential to the conveying mechanism; and a stop operably associated with the conveying mechanism and at least one of said first member and said second member for limiting the travel of at least one of said first member and said second member.

9. An apparatus according to claim 8, wherein at least one of said first member and said second member comprises a metal.

10. An electrophotographic printing machine comprising:

a conveying mechanism for conveying images toward an image transfer area;

a copy sheet chute for guiding copy sheets toward said conveying mechanism;

a body operably associated with the image transfer area;

a first member connected to said body and spaced from the copy sheet chute, said first member having a first member surface for guiding the copy sheet; and a second member operably associated with said first member, connected to said body and spaced from the copy sheet chute, said second member having a second member surface for guiding the copy sheet, said first member and said second member defining a Passageway therebetween for passage of the copy sheets therebetween, said first member surface and said second member surface cooperating with the copy sheets to guide the copy sheets in a path tangential to the conveying mechanism, said first member and said second member being integral with each other.

11. A printing machine according to claim 10, wherein said body is connected to the conveying mechanism.

12. A printing machine according to claim 10, wherein at least one of said first member and said second member are pivotably connected to said body.

13. A printing machine according to claim 10, wherein at least one of said first member and said second member comprises a metal.

14. A printing machine according to claim 10, wherein at least one of said first member and said second member comprises a protrusion extending toward the passageway.

15. A printing machine according to claim 10, wherein the passageway has a width of approximately 2–6 mm.

16. A printing machine according to claim 10, wherein at least one of said first member and said second member is spaced approximately 2–6 mm from the conveying mechanism.

17. An electrophotographic printing machine comprising:

a conveying mechanism for conveying images toward an image transfer area;

a copy sheet chute for guiding copy sheets toward said conveying mechanism;

a body operably associated with the image transfer area;

a first member connected to said body and spaced from the copy sheet chute, said first member having a first member surface for guiding the copy sheet;

a second member operably associated with said first member, connected to said body and spaced from the copy sheet chute, said second member having a second member surface for guiding the copy sheet, at least one of said first member and said second member are pivotably connected to said body, said first member and said second member defining a passageway therebetween for passage of the copy sheets therebetween, said first member surface and said second member surface cooperating with the copy sheets to guide the copy sheets in a path tangential to the conveying mechanism; and a stop operably associated with the conveying mechanism and at least one of said first member and said second member for limiting the travel of at least one of said first member and said second member.

18. A printing machine according to claim 17, wherein at least one of said first member and said second member comprises a metal.

* * * * *